US007422494B2

(12) United States Patent
Fry, Jr. et al.

(10) Patent No.: US 7,422,494 B2
(45) Date of Patent: Sep. 9, 2008

(54) TWO-PIECE ELECTRICAL TERMINAL

(75) Inventors: Daniel W Fry, Jr., Elizabethtown, PA (US); Leo J Graham, Hershey, PA (US); Michael J Vino, Landisville, PA (US); John M Myer, Millersville, PA (US); Hurley C Moll, Hershey, PA (US); Forrest I Kinsey, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/540,219

(22) Filed: Sep. 29, 2006

(65) Prior Publication Data

US 2008/0081519 A1 Apr. 3, 2008

(51) Int. Cl.
*H01R 9/24* (2006.01)

(52) U.S. Cl. ..... 439/891

(58) Field of Classification Search ..... 439/891, 439/866, 843, 884, 862, 825, 871, 850, 849
See application file for complete search history.

(56) References Cited

U.S. PATENT DOCUMENTS 5,240,439 A 8/1993 Egenolf
5,266,056 A 11/1993 Baderschneider et al.
5,295,871 A * 3/1994 Lapraik et al. ..... 439/746
5,308,267 A 5/1994 Hotea
5,399,110 A * 3/1995 Morello et al. ..... 439/879
5,649,842 A * 7/1997 Ohsumi ..... 439/858
5,716,244 A 2/1998 Egenolf et al.
5,716,246 A * 2/1998 Kerckhof et al. ..... 439/884
5,888,107 A * 3/1999 Seymour et al. ..... 439/891
6,004,172 A * 12/1999 Kerek ..... 439/891
6,290,556 B1 * 9/2001 Howland et al. ..... 439/879
6,672,910 B2 1/2004 Hotea
6,755,696 B1 * 6/2004 Ko ..... 439/746
6,790,105 B2 * 9/2004 Fukatsu et al. ..... 439/884
6,890,222 B2 * 5/2005 Serbin et al. ..... 439/879
2005/0118884 A1 * 6/2005 Lutsch et al. ..... 439/746

* cited by examiner

*Primary Examiner*—Alexander Gilman

(57) ABSTRACT

A two piece electrical terminal is shown where one part is comprised of a contact member having a contact section in the form of a pin and retention section. A conductor connecting member is comprised of a conductor connecting section and a retaining member. The contact member has a lug extending along one side thereof and the retaining member has a complementary opening which retains the contact member and conductor connecting member together.

25 Claims, 8 Drawing Sheets

TWO-PIECE ELECTRICAL TERMINAL

BACKGROUND OF THE INVENTION

The subject invention relates to a pin terminal for electrical connection with a corresponding socket terminal.

It is common in electrical connector technology to provide a plurality of wires for example in a harness configuration, attached to a connector housing, and another plurality of wires attached to another harness in yet another complementary connector. One of the connectors would have pin terminals while the other of the connectors would include a receptacle or socket terminal. Multiple considerations need to be considered in designing and manufacturing such terminals, particularly when the application to which the connectors will be subjected to, is considered.

For example, in the automotive field, when electrical connectors are required in a plurality of harness connections, the pins and receptacles are subjected to multiple adverse conditions. First, vibration from the engine or road conditions sometimes provides degradation to the pin and socket connection. Due to the inclement weather conditions in which the automobile needs to operate, most automotive connectors are also sealed, which prevents either water or salt water from encroaching into the connector housing and degrading the electrical connection between the pins and receptacles. Thus for the sealing purposes, it is required to have a pin terminal which is easily insertable through a seal member or a planar seal to which seals the back of the electrical connector.

It is known to provide a two piece electrical connector where a portion is the pin portion and a second portion is the wire crimp which is connected to the pin portion. Typically these two pieces are soldered or laser welded together which can form sharp surfaces which can cut or sever the seals upon insertion there through. It is also necessary to provide a continued connection between the pin portion and the wire connecting portion for making the electrical connection.

SUMMARY OF THE INVENTION

These and other improvements have been achieved by way of providing an electrical terminal, comprising a contact member comprised of a contact section and a retention section. The retention section having at least one locking surface. A conductor connecting member is comprised of a conductor connecting section and a retaining member, where the retaining member engages the at least one locking surface to retain the contact member and conductor connecting member together.

The locking surface may be defined by an undulation, which may be along a side thereof. The retaining member is comprised of plural walls which at least partially overlap the retention section. The one locking surface may be defined by an undulation, and one of the plural walls has an engagement portion for engagement with the undulation. The undulation may be in the form of a tab extending from a side edge thereof. The engagement portion may be formed by an opening in the wall for receipt of the tab. The electrical terminal may comprise plural tabs and plural openings.

The retaining member may be in the form of a box-shaped portion overlapping the retention section. The walls of the box-shaped portion are interconnected within the planes of their respective walls. The contact section may be in the form of a pin. The front edges of the walls may be deflected downwardly towards the pin, to form lead-in surfaces. The electrical terminal may have a rearward edge of said box-shaped portion is formed with a rear flap.

In another embodiment, an electrical terminal is comprised of a contact member comprised of a contact section; a conductor connecting member comprised of a conductor connecting section; a retention section attached to one of the contact member or the conductor connecting member; and a retaining member attached to the other of the contact member or the conductor connecting member, the retaining member being in the form of a box-shaped member which engages the retention section, and has interlocking wall edges to retain the box-shaped form.

The retention section may be comprised of at least one locking surface to retain the contact member and conductor connecting member together. The one locking surface may be defined by an undulation. The undulation may be in the form of a tab extending from a side edge thereof. One of the plural walls of the box-shaped portion may have an engagement portion for engagement with the tab. The engagement portion may be formed by an opening in the wall for receipt of the tab. The electrical terminal may further comprise plural tabs and plural openings.

DETAILED DESCRIPTION OF THE EMBODIMENTS

Figure 1:
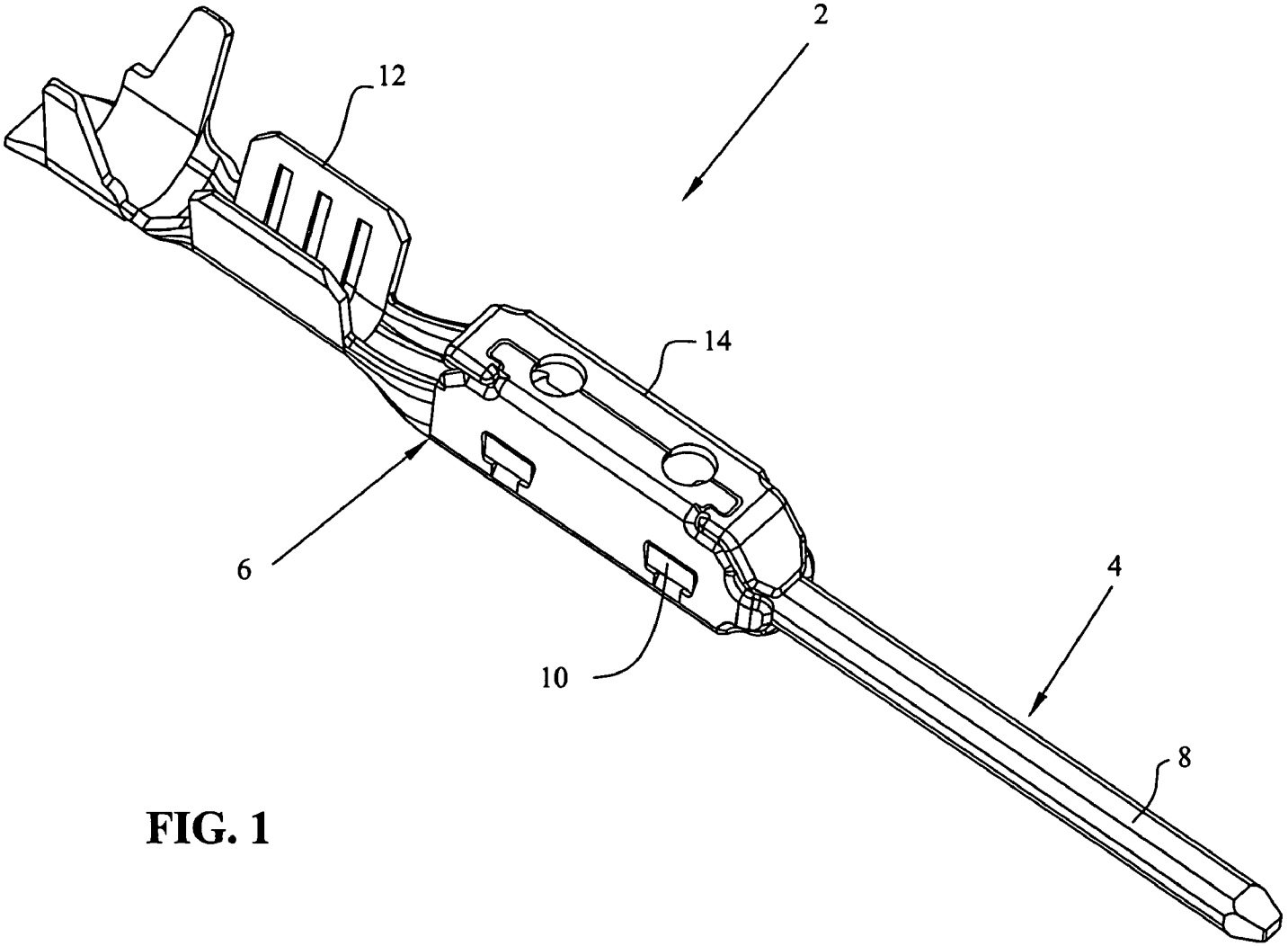
FIG. 1 is a front perspective view of the two piece electrical terminal of the present embodiment.
Figure 2:
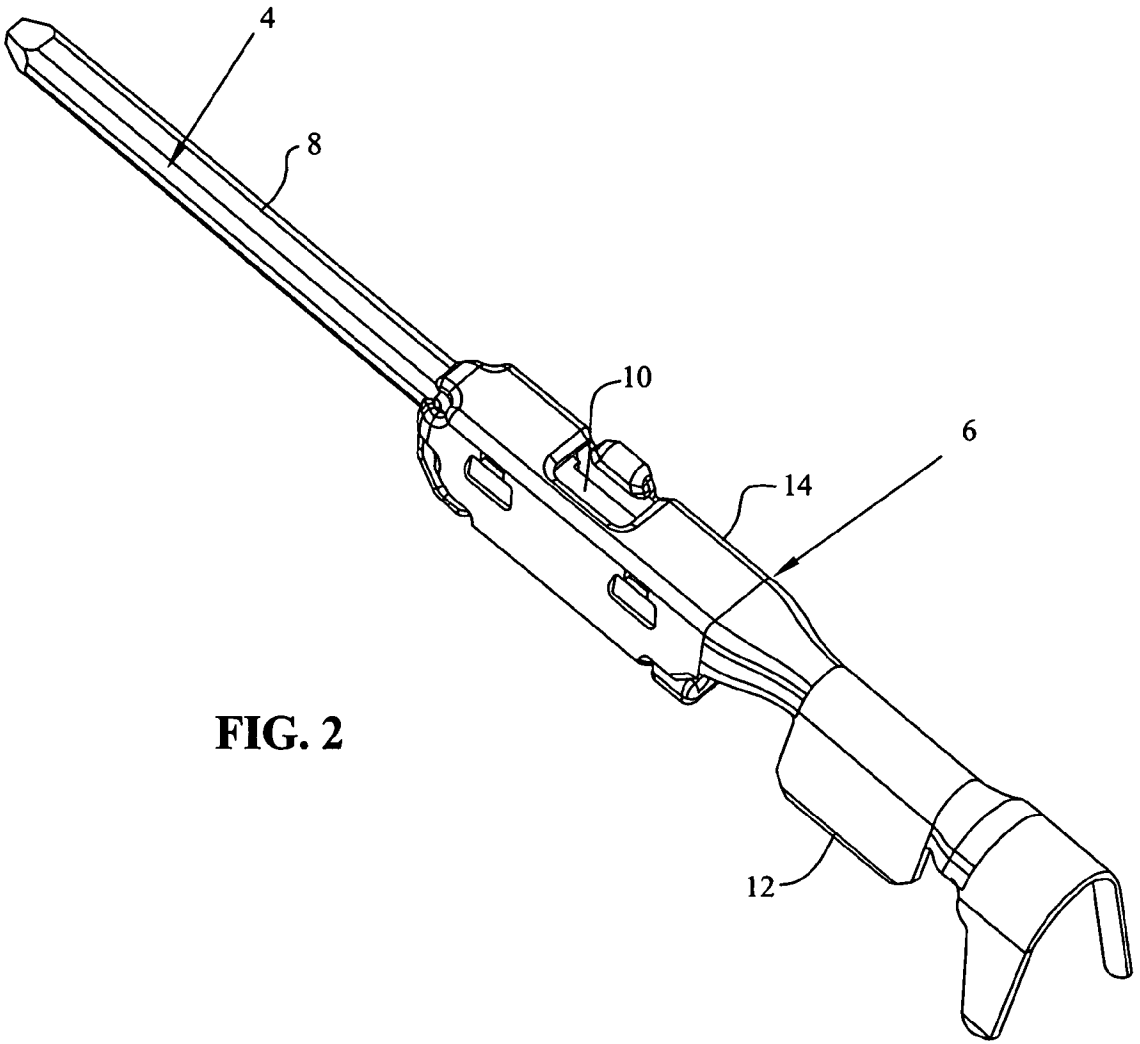
FIG. 2 shows a rear perspective view of the two piece electrical terminal of the present embodiment.
Figure 3:
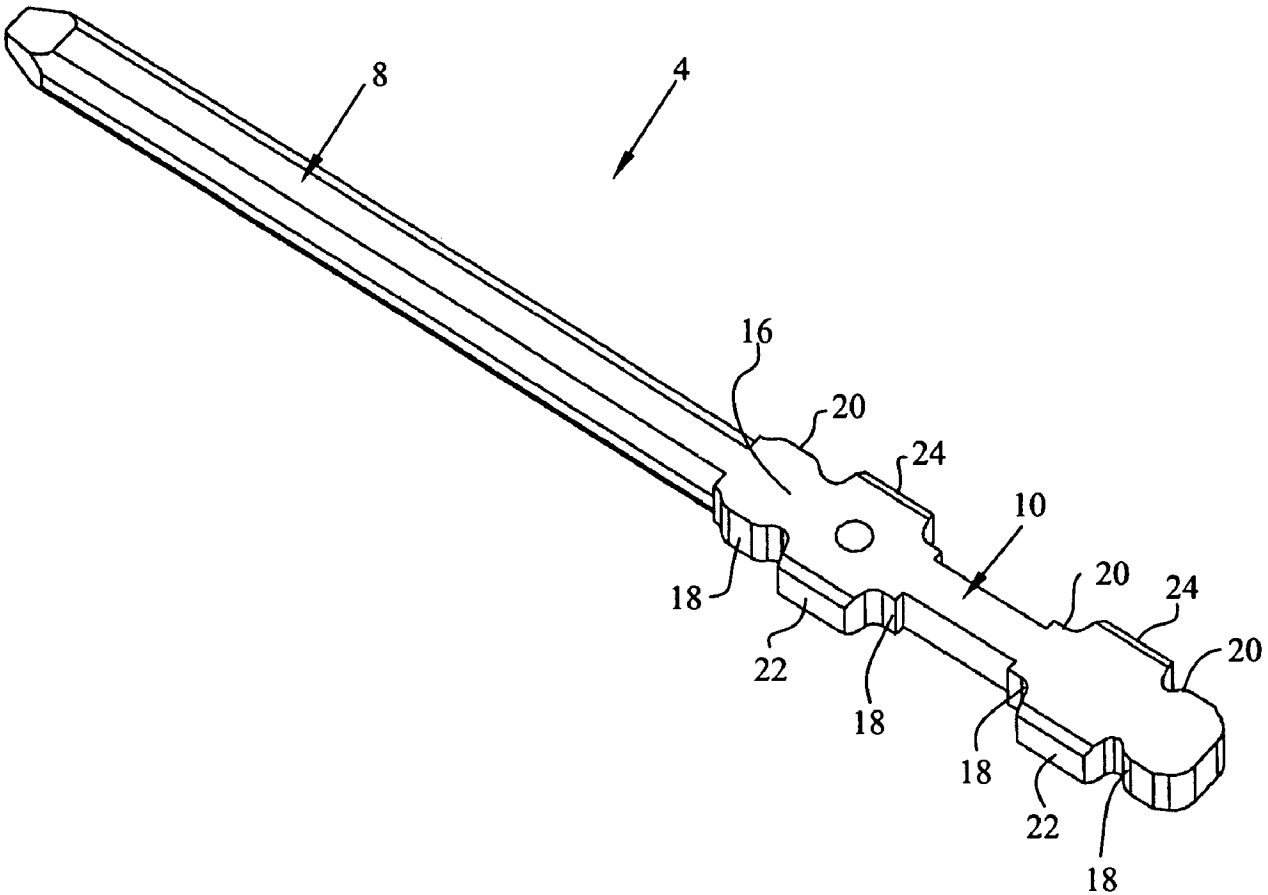
FIG. 3 shows a view similar to that of FIG. 2 with the carrier strip detached.

With reference first to FIGS. 1 and 2, a two piece electrical terminal is shown at 2 and includes a contact member 4 and a conductor connecting member 6. The contact member 4 is generally comprised of a contact section 8 and a retention section 10. The conductor connecting member 6 is comprised of a conductor connecting section 12 and a retaining member 14. With reference now to FIG. 3, the contact member 4 will be described in greater detail.

As shown in FIG. 3, the contact member 4 is shown separated from the conductor connecting member 6 to clearly show the contact section 8 as a pin terminal and the retention section 10 as integrally formed with the contact section 8. The retention section 10 is generally defined by a flat blade portion 16, having side edges 18 on one side thereof, and side edges 20 on the opposite side thereof. Undulations in the form of tabs 22 extend from the side edge 18, while undulations in the form of tabs 24 extend from side edge 20.

Figure 4:
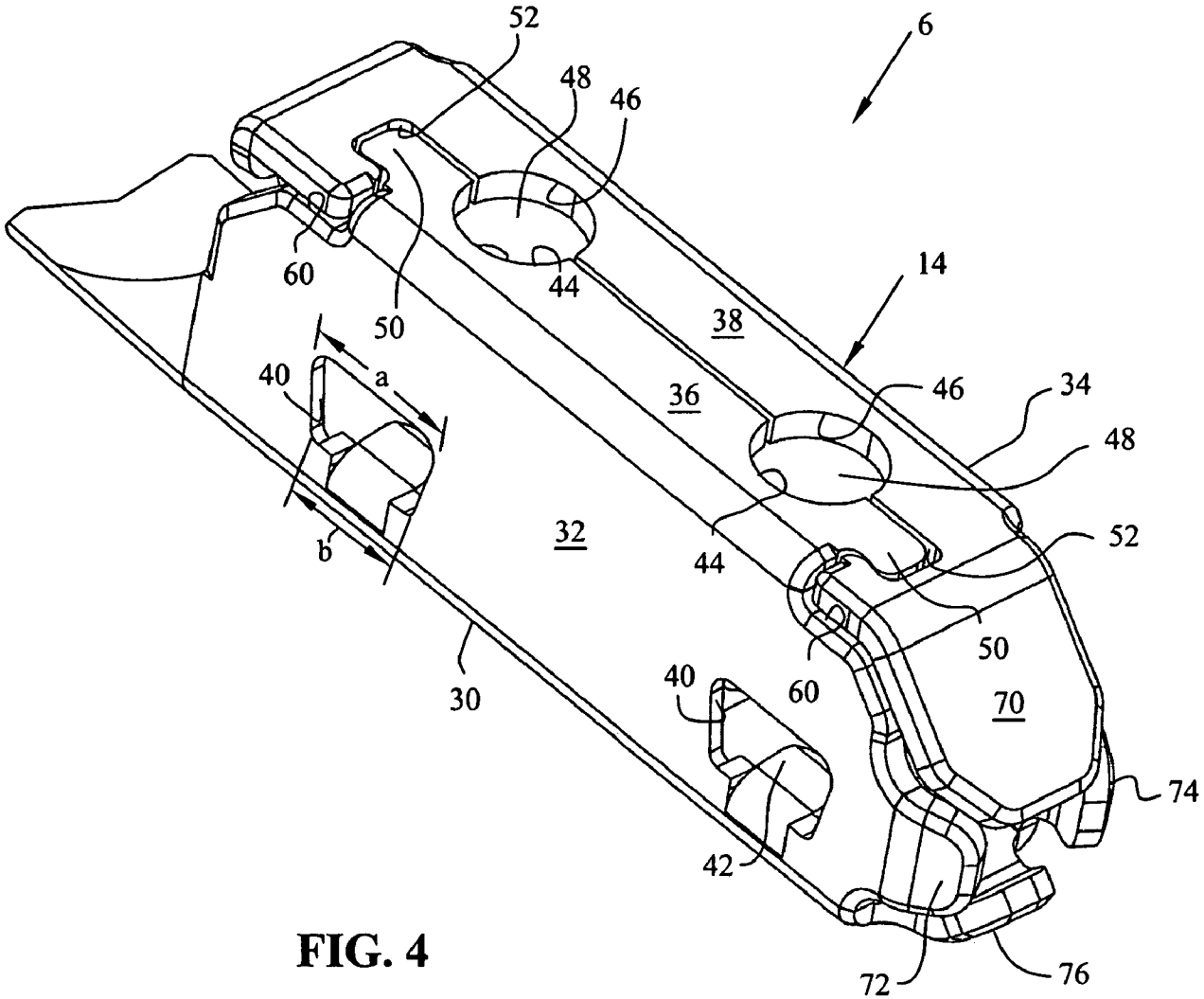
FIG. 4 shows a partially fragmented front view of the conductor connecting member.
Figure 5:
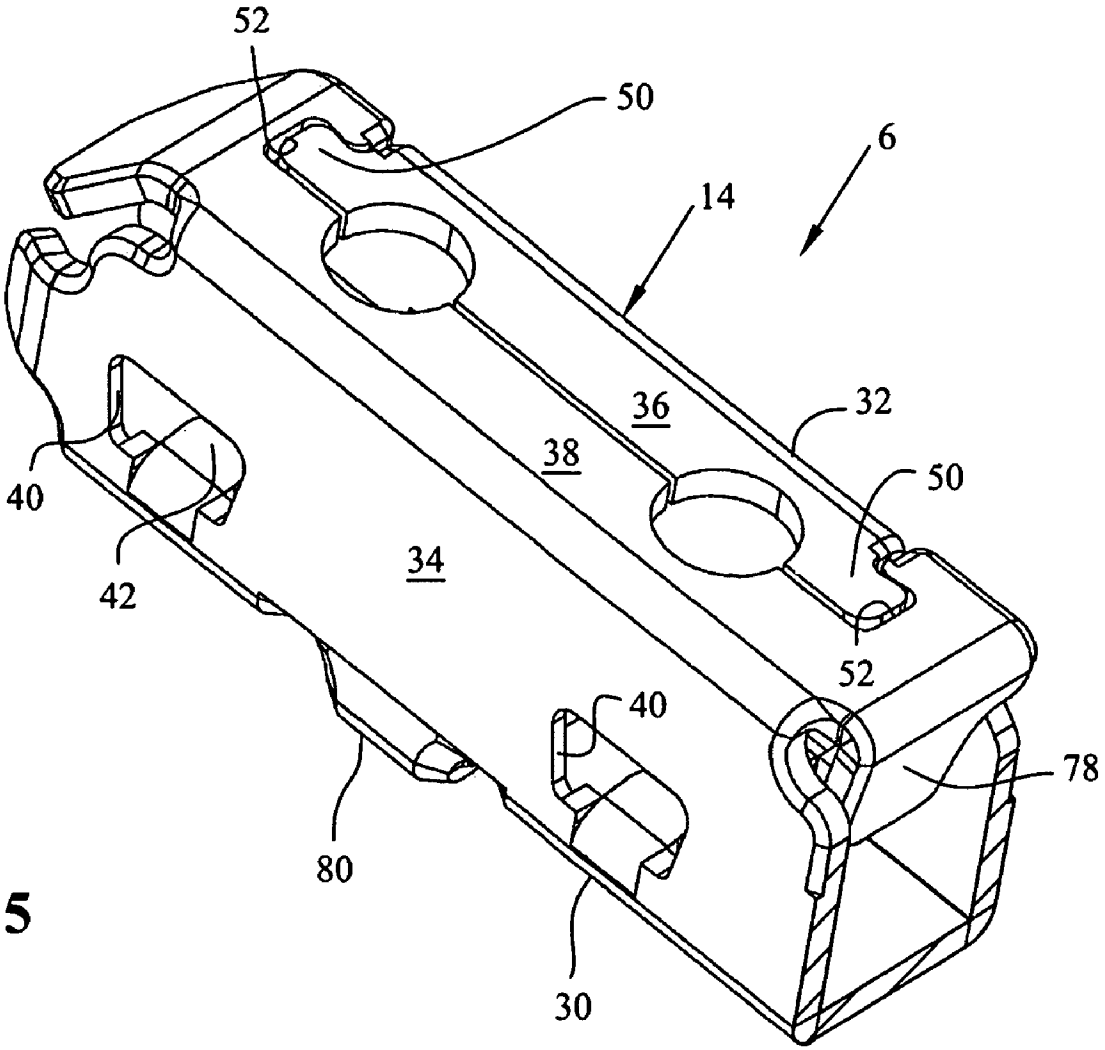
FIG. 5 shows a partially fragmented rear view of the conductor connecting member shown in FIG. 4.

With respect now to FIGS. 4 and 5, the conductor connecting member 6 is shown, and in particular, the retaining member 14 is shown disconnected from the contact member 4. The retaining member 14 is comprised of plural walls, namely bottom wall 30, side walls 32 and 34 and split top walls 36, 38. As shown in FIGS. 4 and 5, walls 32 and 34 include openings 40 stamped there through. Each of the openings 40 includes a contact tab 42 struck from the area of the opening 40 and folded downwardly adjacent to bottom wall 30, as will be described further herein. With reference to FIGS. 4 and 5 split top walls 36, 38 include semi-circular openings 44, 46 which combine to form an opening 48 as described further herein. As shown best in FIG. 4, top wall 36 includes dove tails 50 which cooperate with dove tail slots 52 in top wall 38 to retain the two walls together when in the position shown in FIG. 4.

It should be appreciated that side wall 32 includes cut away portions at 60 (FIG. 4) which allow for top wall 38 to be positioned in the same plane as top wall 36. As shown best in FIG. 4, the front edges of retaining member 14 provide lead in surfaces, by respective front wall portions deflected inwardly. More particularly, top wall 38 includes a portion 70 deflected inwardly towards a central opening through which the pin protrudes. In a like manner, side wall 32 includes inwardly directed portions 72, side wall 34 includes inwardly directed portion 74, and bottom wall 30 includes inwardly directed portion 76.

With respect to FIG. 5, top wall portion 38 also includes a rear tab portion in a form of a flap 78 which provides a surface for a locking member or secondary locking member for the terminal in a connector housing. Finally, as best shown in FIG. 5, retaining member 14 includes a polarizing lug 80 which can be used to polarize the terminal in a specific orientation relative to a connector channel. These various components are also shown in the flat blank view of FIG. 6. Note that the fold lines to form the various walls 30, 32, 34, 36 and 38 are along the dotted lines 84, 86, 88 and 90.

Figure 6:
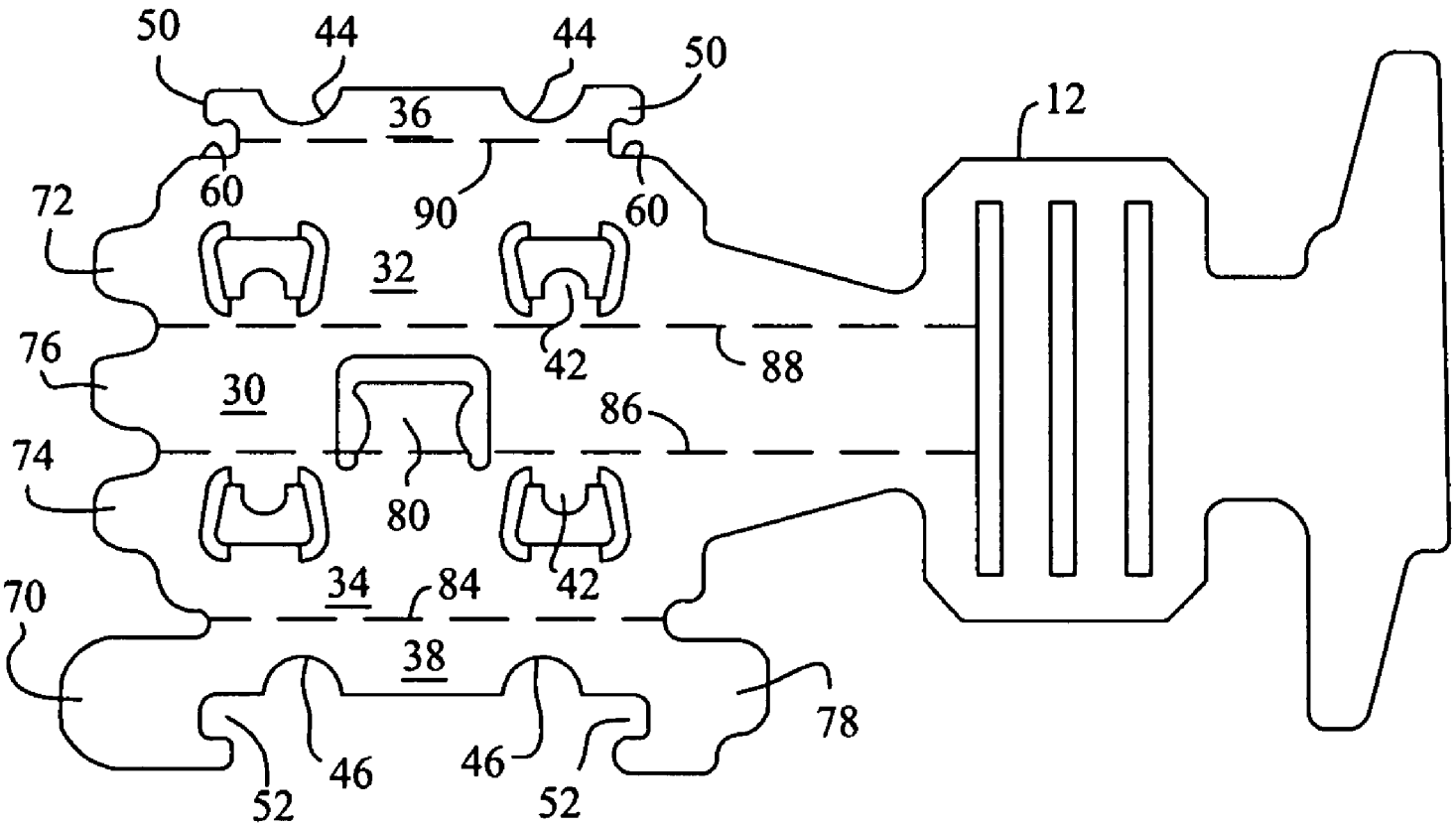
FIG. 6 shows a flat blank of the conductor connecting member shown in either of FIG. 4 or 5, with the conductor connecting section still attached.

With the components described above, the method of manufacturing the terminal will now be described. With the conductor connecting member 6 in the flat blank condition as shown in FIG. 6, the box shaped member is at least partially formed, yet with enough spacing between the split top walls 36, 38 to place the retention section 10 therein adjacent the folded over tabs 42. As shown in FIG. 4, the openings 40 are trapezoidally shaped with the top edge having a dimension "a" which is larger than an lower edge having a dimension "b". With the retention section 10 position therein, and the tabs 22, 24 extending outwardly from the openings 40, the box shaped member can be fully closed to the position shown in FIGS. 4 and 5, whereby the dovetails 50 engage in their corresponding dovetail slots 52.

At this point in time, the contact member 4 is not fully seated within the corresponding conductor connecting member 6. To achieve the fully seated position, tooling can be inserted through openings 48 (FIG. 4) to press against blade portion 16 (FIG. 3) to force the tabs downwardly towards the lower edge having the dimension "b". It should be appreciated that the width of the tabs 22, 24 is slightly larger than the width "b" of the lower edge of opening 40, such that tabs 22, 24 are interference fit within the openings 40. Openings 40 are shaped as trapezoids funneling downwardly to allow for downward, yet interferingly fit engagement in opening 40, which also press fits blade portion 16 against the corresponding overlapping contact tabs 42.

Figure 7:
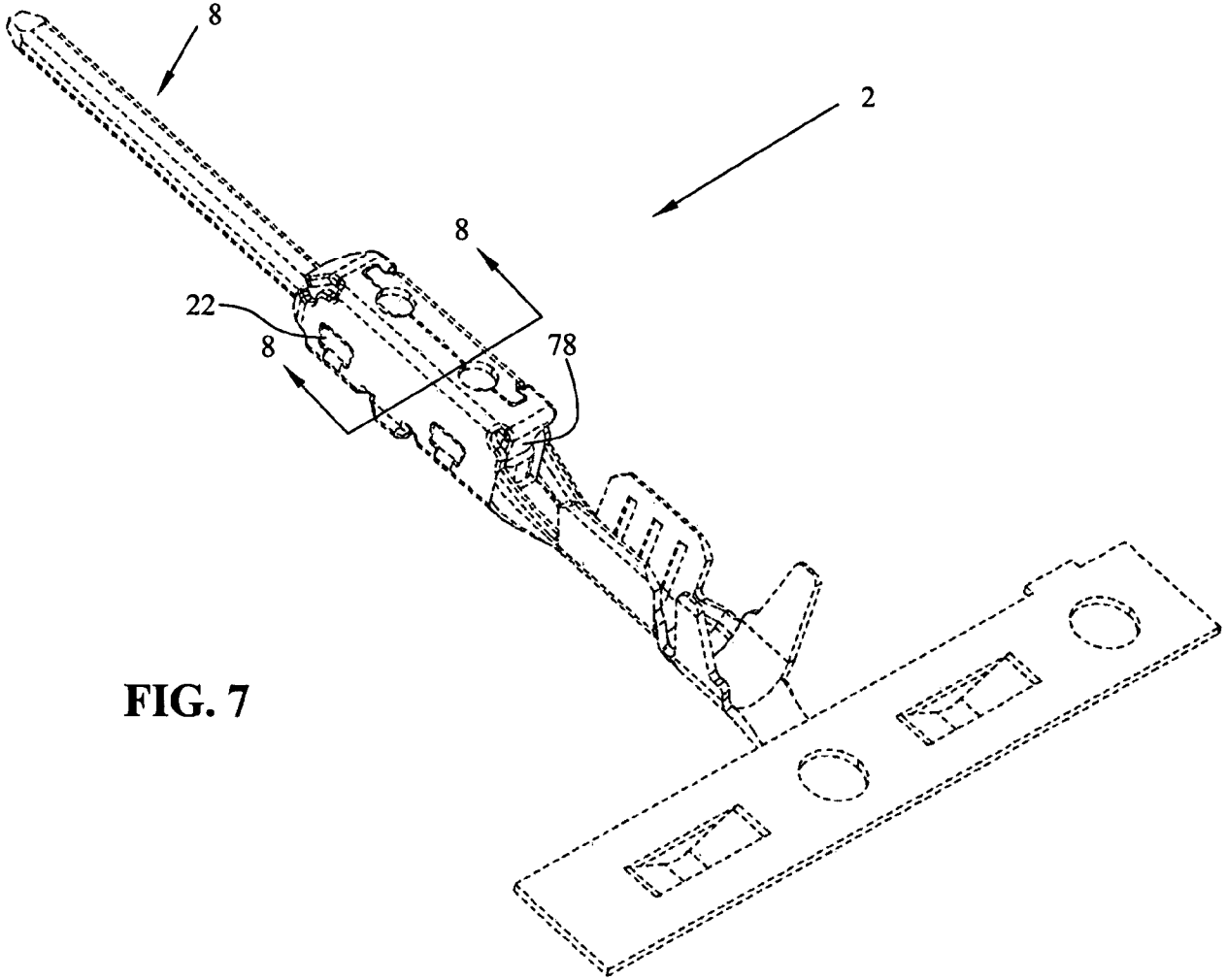
FIG. 7 shows an assembled view of the two-piece electrical terminal from a rear perspective.
Figure 8:
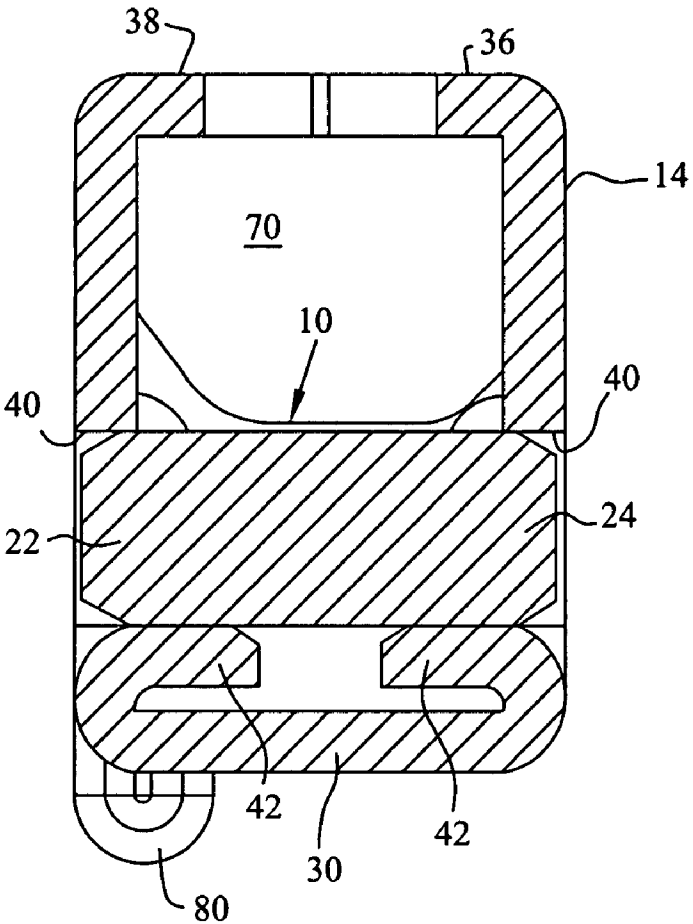
FIG. 8 shows a cross-sectional view through lines 8-8 of FIG. 7.

Thus, as shown in FIGS. 7 and 8, the retaining member 14 is shown wrapped around the retention section 10, with the tabs 22, 24 protruding through their respective openings 40. It is also shown that folded over contact tabs 42 provide a platform upon which the retention section 10 may be positioned, which also provides adequate surface area for making contact between the contact member 4 and the conductor connecting member 6. Thus as shown, the combination of the tabs 22, 24 and openings 40 provide excellent retention between the two members 4 and 6, and at the same time provide electrical connection between the two items together with the connection of the retention section and the contacts 42.

What is claimed is:

1. An electrical terminal, comprising:

a contact member comprised of a contact section having contact surfaces for mating with a mating connector and a retention section, said retention section having at least one forwardly facing locking surface; and a conductor connecting member comprised of a conductor connecting section and a retaining member having at least one rearwardly facing locking surface, the retaining member engaging and interlocking with said at least one forwardly facing locking surface to retain the contact member and conductor connecting member together.

2. The electrical terminal of claim 1, wherein said at least one forwardly facing locking surface is defined by an undulation.

3. The electrical terminal of claim 2, wherein said at least one forwardly facing locking surface is defined by an undulation formed along a side thereof.

4. The electrical terminal of claim 1, wherein said retention section makes electrical contact with said retaining member.

5. The electrical terminal of claim 4, wherein said retention section includes a blade portion and the retaining portion includes contact tabs which contact said blade portion.

6. The electrical terminal of claim 5, wherein said contact tabs are spring loaded upwardly against said blade portion.

7. The electrical terminal of claim 1, wherein said retaining member is comprised of plural walls which at least partially overlap said retention section.

8. The electrical terminal of claim 7, wherein said at least one forwardly facing locking surface is defined by an undulation, and one of said plural walls is provided with the at least one rearwardly facing locking surface for engagement with said undulation.

9. The electrical terminal of claim 8, wherein said undulation is in the form of a tab extending from a side edge thereof.

10. The electrical terminal of claim 8, wherein said rearwardly facing locking surface is formed by an opening in said wall for receipt of said tab.

11. The electrical terminal of claim 10, comprising plural tabs and plural openings.

12. The electrical terminal of claim 7, wherein said retaining member is in the form of a box-shaped portion overlapping said retention section.

13. The electrical terminal of claim 12, wherein said walls of said box-shaped portion are interconnected within the planes their respective walls.

14. The electrical terminal of claim 13, wherein said contact section is in the form of a pin.

15. The electrical terminal of claim 14, wherein front edges of said walls are deflected downwardly towards said pin, to form lead-in surfaces.

16. The electrical terminal of claim 13, wherein a rearward edge of said box-shaped portion is formed with a rear flap.

17. An electrical terminal, comprising:

a contact member comprised of a contact section having contact surfaces for mating with a mating connector;

a conductor connecting member comprised of a conductor connecting section;

a retention section attached to one of said contact member or said conductor connecting member, having a first locking face substantially transverse with a longitudinal length of the retention; and a retaining member attached to the other of said contact member or said conductor connecting member, the retaining member being in the form of a box-shaped member and having a second locking face substantially transverse with a longitudinal length of the retaining member which interlockingly engages the first locking face of the retention section, and has interlocking wall edges to retain the box-shaped form.

18. The electrical terminal of claim 17, wherein said first locking surface is defined by an undulation.

19. The electrical terminal of claim 18, wherein said undulation is in the form of a tab extending from a side edge thereof.

20. The electrical terminal of claim 19, wherein one of plural walls of the box-shaped portion is provided with the second locking face for engagement with said tab.

21. The electrical terminal of claim 20, wherein said second locking face is formed by an opening in said wall for receipt of said tab.

22. The electrical terminal of claim 21, further comprising plural tabs and plural openings.

23. The electrical terminal of claim 17, wherein said retention section makes electrical contact with said retaining member.

24. The electrical terminal of claim 23, wherein said retention section includes a blade portion and the retaining portion includes contact tabs which contact said blade portion.

25. The electrical terminal of claim 24, wherein said contact tabs are spring loaded upwardly against said blade portion

* * * * *